US010577913B2

(12) United States Patent
Daubner

(10) Patent No.: US 10,577,913 B2
(45) Date of Patent: Mar. 3, 2020

(54) METHOD AND CONSTRUCTION MACHINE FOR WORKING THE SOIL

(71) Applicant: BAUER Spezialtiefbau GmbH, Schrobenhausen (DE)

(72) Inventor: Marcus Daubner, Aichach (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 162 days.

(21) Appl. No.: 15/641,007

(22) Filed: Jul. 3, 2017

(65) Prior Publication Data

US 2018/0080311 A1 Mar. 22, 2018

(30) Foreign Application Priority Data

Sep. 21, 2016 (EP) ..... 16189878

(51) Int. Cl.

| | |
|---|---|
| ***E21B 44/04*** | (2006.01) |
| ***E02D 17/13*** | (2006.01) |
| ***E02F 3/22*** | (2006.01) |
| ***E02F 9/26*** | (2006.01) |
| *E02D 7/22* | (2006.01) |
| *E02D 17/00* | (2006.01) |

(52) U.S. Cl.

CPC ..... *E21B 44/04* (2013.01); *E02D 17/13* (2013.01); *E02F 3/22* (2013.01); *E02F 9/26* (2013.01); *E02D 7/22* (2013.01); *E02D 17/00* (2013.01)

(58) Field of Classification Search

CPC ..... E21B 44/04
USPC ..... 175/24
See application file for complete search history.

(56) References Cited

U.S. PATENT DOCUMENTS

2012/0012391 A1* 1/2012 Trevisani ..... E02D 17/13 175/57
2014/0116776 A1* 5/2014 Marx ..... E21B 44/00 175/24

FOREIGN PATENT DOCUMENTS

| | | |
|---|---|---|
| DE | 103 08 539 B3 | 6/2004 |
| EP | 1 580 398 A1 | 9/2005 |
| JP | H09-089563 A | 4/1997 |

OTHER PUBLICATIONS

The extended European search report issued by the European Patent Office dated Apr. 4, 2017, which corresponds to EP16 18 9878.

* cited by examiner

*Primary Examiner* — Taras P Bemko
(74) *Attorney, Agent, or Firm* — Studebaker & Brackett PC

(57) ABSTRACT

The invention relates to a method for working the soil and an associated construction machine, which comprises at least one rotating drive unit for rotationally driving a tool for working the soil and at least one feed unit, with which the tool for working the soil is placed into the ground. According to the invention, a control and analysis unit is provided, with which when working the soil at least one input variable of the rotating drive unit and/or the feed unit are read and saved, at least one resulting output parameter is read and saved at the tool for working the soil, and the at least one input variable is compared to the resulting output parameter, whereby a soil working value is ascertained and saved.

11 Claims, No Drawings

METHOD AND CONSTRUCTION MACHINE FOR WORKING THE SOIL

The invention relates to a method for working the soil with a construction machine, which comprises at least one rotating drive for rotationally driving a tool for working the soil and at least one feed unit, with which the tool for working the soil is placed into the ground.

The invention furthermore relates to a construction machine for working the soil with a rotating drive for rotationally driving a tool for working the soil and a feed unit, with which the tool for working the soil is placeable into the ground in an advancing direction.

Construction machines for working the soil might be, for instance rigs for the pile boring or diaphragm wall cutters for the creation of diaphragm walls in the ground. In a drilling rig, a drilling tool is rotatably driven by a drill drive and placed into a ground mostly vertically by means of a feed unit. For an efficient creation of a drill hole it is thereby crucial that the revolution speed and a feed rate are coordinated and adjusted.

With respect to simple drilling rigs, the revolution speed and a feed rate are set manually by the operator of a drilling rig. The right setting therefore decisively depends on the experience of the operator of the drilling rig, as the setting also depends on the type of soil.

It is known that drilling rigs are provided with an electronic control, in which preset programs are provided, which can be selected by the operator of the drilling rig, depending on the given type of soil. In these programs, a revolution speed of the drilling tool and a feed rate can be provided for a specific type of soil, for instance. The control is then adjusted and controlled at the drilling rig based on these target values for the torque and the feed force. The resulting actual values can be measured and compared to the target values, so that there is a conventional control in place.

However, such preselection programs also further require the corresponding experience of the operator of the drilling rig. First of all, the correct program has to be selected. Even if a correct program is selected, for instance for sandy soil, it can happen that during the deepening of the drill various layers of soil have to be penetrated, which might have different firmness and cohesions. A revolution speed and a feed rate which are efficient for sandy soil may thus lead to excessive tool wear, an increased energy consumption or an impairment of the drilling progress in rocky or lamey soil.

The object of the invention is to provide a method and construction machine for working the soil, with which it is made possible to efficiently work the soil in a particularly reliable way.

The method according to the invention is characterized in that a control and analysis unit is provided, with which when working the soil at least one input variable of the rotating drive and/or the feed unit are read and saved, at least one resulting output parameter is read and saved at the tool for working the soil, and the at least one input variable is compared to the resulting output parameter, whereby a soil working value is determined and saved.

A basic idea of the invention is that when working the soil at least one input variable and at least one output parameter is read continuously or at regular intervals and compared to one another by means of a control and analysis unit. If, for instance, a specific torque is preset as input variable at the rotating drive unit, the revolution speed that—depending on the soil—is adjustable at the tool for working the soil, for instance a drilling tool or milling wheel here from allows conclusions regarding the type of the soil, for instance whether it is firm or loose. The control and analysis unit can thus reflect the workability of the soil by way of a comparison of input variable resulting and output parameter, whereby a soil working value is determined. Said soil working value can be displayed to an operator of the machine or considered directly in the control for the further operation of the drive units and the feed units.

Particularly when cutting through lower ground layers, which are not recognizable for on operator of a machine, in this manner the respective ground layer to be worked can be assessed, which is helpful for a more efficient adjustment of the input variable, i.e. the operation parameters, by the operator of the machine or the control itself. In such a manner, a processing with a most efficient or effective adjustment of the drive units, particularly the rotating drive unit and the feed unit may take place.

A preferred further development of the method according to the invention is that the at least one input variable and the at least one output parameter are read and saved over time and/or the length of the advancing section. If, for instance, at a construction site several bores or slots have to be created, which are positioned usually close to one another or not too far away from each other, the stored input variables and output parameters that were read and saved over the time or the advancing section in one work process are used for setting up an iterative loop. It is particularly possible to create a profile with the respective soil working value through an advancing section, i.e. a drilling depth or a slot depth, to which in each case a dataset with preferred operating parameters for the input variables is assigned.

Principally, a plurality of different input variables can be read individually and in combination. The more input variables are considered, the more meaningful are the conclusions regarding the soil and the more precise is a soil working value and thus a conclusion regarding the workability of the soil. According to one embodiment of the invention, it is particularly preferred that a torque of the rotating drive unit, a feed force of the feed unit and/or a pressure or volume in a hydraulic system is selected as input variable for driving the rotating drive unit and/or the feed unit. The rotating drive unit can thereby be a drill drive or a drive of the cutter wheel. In the process, the torque can be directly measured. In a hydraulic drive system, the torque and thus the measured performance can be measured indirectly through parameters in the hydraulic system, in particular a pressure or a volume flow in the hydraulic system.

The same applies accordingly for a feed unit, which can take place through a winch or through support cylinders, which can be driven by a hydraulic drive system as well. However, the feed unit can be provided as load in a cutter for diaphragm walls or the weight of the cutter for instance, which is suspended from a winch cable and reduces the load by a corresponding counterforce of the winch. The load can thus be calculated through the corresponding force sensors or mathematically through a winch torque in consideration of the weight of the cutter for diaphragm walls and when determining the soil working value.

The same applies with respect to the selection of the output parameters. The output parameters are thereby correlated to an assigned input variable. According to the invention it is thereby particularly preferred that a revolution speed and/or a feed rate are selected as output parameter of the soil working tool. A torque of a rotation drive unit is, for instance, related to the revolution speed of a soil working tool, such as a drilling tool or a cutter wheel. In a feed unit, a feed force or a load is connected to a resulting feed rate. In a softer soil, naturally a higher feed rate results in combination with a preset feed force than with more solid soils. The feed rate can also be designated as penetration velocity or advance speed into the ground.

The mentioned input variables and output parameters are only preferred parameters. These can also be interchanged. Thus, by means of the control unit for example a revolution speed could also be predetermined as input variable, whereby the resulting output parameter is then measured as an adjusting torque or as a performance tap at the rotating drive unit.

Another preferred embodiment of the invention provides that the control and analysis unit comprises a database, in which preferred input variables for specific soil working values are saved. The database can already be provided on delivery of a construction machine or can be installed during operation by a central office, or provided with new or supplemented values and maintained. In addition, according to a variant of the invention it is possible that datasets that are preferred by the operator of the machine or by the control and analysis unit as such, i.e. preferred input variables are stored, where applicable with output parameters for specific soil working values, which were created or determined for a respective construction site or the respective machine. The database can thus constitute an expert system, whereby an automatic improvement and the change of the saved data sets can also be provided on the basis of a preferably self-learning logic of the control and analysis unit.

According to an advantages variant of the method according to the invention, it is foreseen that the control and analysis unit compares a present soil working value with the soil working values saved in the database, and that—depending on such comparison—a given input variable is changed or a change is recommended to an operator of a drilling rig. If, for instance, the control and analysis unit detects within the framework of a comparison of the input variable, for instance the torque, and a resulting output parameter, i.e. the adjusting revolution speed of the drilling tool or the cutter wheel, that a ground layer with a changed firmness and thus with a different soil working value is cut through, the control and analysis unit may change the input variables in accordance with the currently determined soil working value. If in this process a dataset with a same or a similar soil working value is determined in the database, the control or analysis unit may change the input variable in accordance with the determined dataset or display it for example to the operator of the machine on a monitor. In an automatic mode, the previous input variable may be replaced by a more suitable input variable for the soil working value. In such an event, an adjusted torque would thus be changed depending on the determined soil working value after the analysis of the database.

According to a variant of the method according to the invention it is particularly advantageous when cutting through a ground with different soil layers that based on the soil working values determined across the advancing section while working the soil a ground profile is determined and saved by means of the analysis and control unit. In this process, a specific type of soil, e.g. loam, sand, gravel, rock, etc. can be assigned to a soil working value based on the respectively deposited data in the database. These values and thus a ground profile can be retrieved via the control and analysis unit from a central office via a preferably existing remote data connection. Consequently, a construction machine cannot only be used for working the soil, but it can also be used as probing or analysis tool for exploring a ground profile.

According to another embodiment of the method according to the invention it is preferred that input variables that are preferred for the ground profile are determined by the control and analysis unit across the advancing section and are deposited as dataset in the database. In such a manner, a sample data record can be prepared, for instance for a bore at a construction site, whereby a first torque and a first feed force are saved up to a first drill depth, subsequently, a second torque with a second feed force are saved up to a second drill depth, etc. Such a dataset for a drill or slot can then be retrieved for a further drill at the same construction site. In this respect it can be assumed that a ground profile does not or hardly change on a construction site, in particular, if the bores or slots are provided close to one another. This is often the case when creating pile walls or diaphragm walls. By means of the data of the sample drill or the sample slot, the further drills or slots can effectively also be created by less experienced machine operators.

According to a further development of the method according to the invention, it is foreseen that the control and analysis unit determines and saves different datasets for one ground profile, which are preferably determined and differentiated with respect to a quick propulsion or a torque causing only little wear. It is thereby taken into account that there is no general optimal parameter setting for the input variables for working the soil. In fact, the preferred input variables depend on specific aspects or the targets to be achieved when working the soil. For example, a particularly quick working of the soil, i.e. a quick propulsion may be desired, which is why higher revolution speeds or larger feed forces have to be foreseen, in contrast to a way that causes as little wear as possible or an energy-saving way of working the soil. Other targets may also be provided, such as low-noise works. For a determined soil working value different datasets can thus be saved for different targets, which are categorized as ensuring efficient propulsion, being particularly low-wear, energy-saving, or producing little noise emission.

Principally, the method according to the invention is applicable in different variants of working the soil. A particularly preferred variant of the method is that the soil is worked by drilling with a drilling tool. The drilling can thereby take place as continuous drilling, for instance with a continuous flight auger, or as discontinuous drilling, for instance with a drilling bucket, or with a simple auger. The method according to the invention is also applicable for double head drilling, in which at least two rotating drive units are provided. In that, a first rotating drive unit could be provided for an internal drilling tool, while another rotating drive unit is arranged for an external boring tube. Driving into the ground also comprises rock drilling, which for example, can be carried out with respect to anchor drilling or HDI drilling in an approximate vertical wall or even in the ceiling construction in a tunnel.

Another preferred variant of the method provides that the soil is worked by milling with a diaphragm wall cutter. A diaphragm wall cutter comprises at least one pair, preferably two pairs, of rotatably driven cutter wheels. The milling of a slot can thereby be carried out in a one-phase, two-phase, or a CSM®-procedure, in which in the slot in situ a soil binder mixture is produced by the milling machine. There can be one or several cutter wheel drives provided for.

With the control and analysis unit according to the invention, an addition of a binder, flushing suspension and/or a stabilizing slurry can also be considered when drilling or milling. In particular with respect to a CSM® milling process, it might be reasonable to adjust the supply of stabilizing slurry and binder suspension in case of a change of the revolution speed and the feed rate.

The construction machine for working the soil according to the invention is characterized in that a control and analysis unit is provided, which is designed to read and to save at least one input variable of the rotating drive unit and/or the feeding unit when working the soil, to read and store at least one resulting output parameter at the tool for working the soil, and to compare the at least one input variable with the resulting output parameter, whereby a device for working the soil is ascertainable and storable.

With the construction machine according to the invention in particular the above-described method for working the soil can be carried out. The advantages described above can be reached in this manner.

The most various construction machines can be used for working the soil and in particular for soil excavations. A particularly preferred construction machine according to the invention provides a drilling rig for this in which a drilling tool is rotatably driven by means of the at least one rotating drive unit. The drilling tool might thereby be provided as drilling bucket or auger, which is preferably vertically displaceable along a mast or a leader. The drilling rig can also comprise a drill truck that is multi-axially adjustable in a room, in a way that is applied for anchor drilling or HDI drilling. Principally, all drilling rigs are applicable, for instance for double head drilling or for drilling rigs with piping machinery, in which boring tubes are placeable in the ground.

According to another preferred embodiment of the invention, it is foreseen that this is a diaphragm wall cutter in which the cutter wheels are driven by means of the at least one rotating drive unit. The diaphragm wall cutter comprises one or several pairs of cutter wheels at the lower end of a milling frame. The milling frame can be suspended on a rope and guided in the milling slot through corresponding guiding plates provided at the milling frame. Alternatively, the diaphragm wall cutter can also be guidable and movable at a guide rod.

The invention claimed is:

1. A method for working the soil with a construction machine, which comprises at least one rotating drive for rotationally driving a tool for working the soil and at least one feed unit, with which the tool for working the soil is placed into the ground, wherein a control and analysis unit is provided with which at least one input variable of the rotating drive unit and/or the feed unit are read and saved when working the soil, the at least one input variable being an operational variable of the rotating drive unit and/or the feed unit, at least one resulting output parameter, resulting from the at least one input variable, is measured, read, and saved at the tool for working the soil, the at least one input variable is compared to the resulting output parameter, whereby a soil working value is determined and saved, the at least one input variable and/or the at least one output parameter are read and saved over time and/or the length of the advancing section, and a ground profile is determined and saved based on the soil working values determined across the advancing section when working the soil, and wherein a torque of the rotating drive unit, a feed force of the feed unit and/or a pressure or volume in a hydraulic system is selected as input variable for driving the rotating drive unit and/or the feed unit.

2. The method according to claim 1, wherein the control and analysis unit comprises a database, in which preferred input variables are deposited for specific soil working values.

3. The method according to claim 2, wherein the control and analysis unit compares a current soil working value with the soil working values saved in the database, and depending on the comparison, a current input variable is changed or a change is recommended to the operator of the machine.

4. The method according to claim 1, wherein input variables that are preferred for the ground profile are determined by the control and analysis unit across the advancing section and are deposited as a dataset in the database.

5. The method according to claim 1, wherein the control and analysis unit determines and saves different datasets for the ground profile, which are preferably determined and differentiated with respect to a quick propulsion or a torque causing only little wear.

6. The method according to claim 1, wherein the soil is worked by drilling with a drilling tool.

7. The method according to claim 1, wherein the soil is worked by milling with a diaphragm wall cutter.

8. Construction machine for working the soil, particularly by using the method according to claim 1, with a rotating drive unit for rotationally driving a tool for working the soil and a feed unit, with which the tool for working the soil is placeable into the ground in an advancing direction, wherein a control and analysis unit is provided that is designed to read and save at least one input variable of the rotating drive unit and/or the feed unit when working the soil, the at least one input variable being an operational variable of the rotating drive unit and/or the feed unit, measure, read, and save at least one resulting output parameter, resulting from the at least one input variable, at the tool for working the soil, compare the at least one input variable to the resulting output parameter, whereby a soil working value is ascertainable and storable, read and save, over time and/or the length of the advancing section, the at least one input variable and/or the at least one output parameter, and determine and save a ground profile based on the soil working values determined across the advancing section when working the soil, and wherein a torque of the rotating drive unit, a feed force of the feed unit and/or a pressure or volume in a hydraulic system is selected as input variable for driving the rotating drive unit and/or the feed unit.

9. The construction machine according to claim 8, wherein said construction machine is a drilling rig in which a drilling tool is rotatably driven by means of the at least one rotating drive unit.

10. The construction machine according to claim 8, wherein said construction machine is a diaphragm wall cutter, in which the cutter wheels are driven by means of the at least one rotating drive unit.

11. The method according to claim 1, wherein

A method for working the soil with a construction machine, which comprises at least one rotating drive for rotationally driving a tool for working the soil and at least one feed unit, with which the tool for working the soil is placed into the ground, wherein a control and analysis unit is provided with which at least one input variable of the rotating drive unit and/or the feed unit are read and saved when working the soil, the at least one input variable being an operational variable of the rotating drive unit and/or the feed unit, at least one resulting output parameter, resulting from the at least one input variable, is measured, read, and saved at the tool for working the soil, the at least one input variable is compared to the resulting output parameter, whereby a soil working value is determined and saved, the at least one input variable and/or the at least one output parameter are read and saved over time and/or the length of the advancing section, and a ground profile is determined and saved based on the soil working values determined across the advancing section when working the soil, and wherein a revolution speed and/or a feed rate of the soil working tool are selected as output parameter.

* * * * *